US007758740B2

(12) United States Patent
Shook et al.

(10) Patent No.: US 7,758,740 B2
(45) **Date of Patent: *Jul. 20, 2010**

(54) ELECTROCHEMICAL REDUCTION OF METAL OXIDES

(75) Inventors: Andrew Arthur Shook, Eleebana (AU); Gregory David Rigby, Charles Town (AU); Ivan Ratchev, Georgetown (AU)

(73) Assignee: Metalysis Limited (GB)

( * ) Notice: Subject to any disclaimer, the term of this patent is extended or adjusted under 35 U.S.C. 154(b) by 1101 days.

This patent is subject to a terminal disclaimer.

(21) Appl. No.: 10/561,597

(22) PCT Filed: Jun. 21, 2004

(86) PCT No.: PCT/AU2004/000809

§ 371 (c)(1),
(2), (4) Date: May 15, 2006

(87) PCT Pub. No.: WO2004/113593

PCT Pub. Date: Dec. 29, 2004

(65) Prior Publication Data

US 2006/0226027 A1 Oct. 12, 2006

(30) Foreign Application Priority Data

Jun. 20, 2003 (AU) ..... 2003903150

(51) Int. Cl.
*C25C 3/00* (2006.01)
*C25C 7/00* (2006.01)
*C25C 7/02* (2006.01)

(52) U.S. Cl. ..... 205/367; 204/245

(58) Field of Classification Search ..... None
See application file for complete search history.

(56) References Cited

U.S. PATENT DOCUMENTS 4,045,308 A 8/1977 White et al.

(Continued)

FOREIGN PATENT DOCUMENTS

BR 9203400-4 A 8/1992

(Continued)

OTHER PUBLICATIONS

English Translation of Russian Office Action dated Jan. 19, 2009 relating to Russian Appln. No. 2006137273/02 (040574) filed Mar. 22, 2005 based upon PCT/AU2005/000409 corresponding to U.S. Appl. No. 11,522/761 filed Sep. 18, 2006.

(Continued)

*Primary Examiner*—Harry D Wilkins, III
(74) *Attorney, Agent, or Firm*—Brinks Hofer Gilson & Lione; G. Peter Nichols

(57) ABSTRACT

An electrolytic cell for electrochemically reducing metal oxide powders and/or pellets is disclosed. The cell includes a cathode (25) in the form of a plate that has an upper surface for supporting metal oxide powders and/or pellets. The plate is horizontally disposed or slightly inclined and has a forward end and a rearward end and is immersed in an electrolyte bath. The plate is supported for movement so as to cause metal oxide powders and/or pellets on the upper surface of the plate to move toward a forward end of the plate. The cell also includes a means for causing metal oxide powders and/or pellets to move over the upper surface of the plate toward the forward end of the cathode while in contact with molten electrolyte whereby electrochemical reduction of the metal oxide to metal can occur. A method of continuously or semi-continuously reducing metal oxide powders and/or pellets in the cell is also disclosed.

23 Claims, 1 Drawing Sheet

U.S. PATENT DOCUMENTS

| | | | | |
|---|---|---|---|---|
| 4,659,263 | A * | 4/1987 | Hanrot et al. | 406/89 |
| 5,006,209 | A | 4/1991 | Beck et al. | |
| 5,089,094 | A | 2/1992 | Ogasawara et al. | |
| 5,498,320 | A * | 3/1996 | Rendall | 205/385 |
| 6,540,902 | B1 | 4/2003 | Redey et al. | |
| 6,663,763 | B2 | 12/2003 | Strezov et al. | |
| 6,712,952 | B1 | 3/2004 | Fray et al. | |
| 6,921,473 | B2 | 7/2005 | Ward-Close et al. | |
| 7,470,355 | B2 * | 12/2008 | Osborn et al. | 205/401 |
| 2003/0047462 | A1 | 3/2003 | Ward-Close et al. | |
| 2003/0057101 | A1 | 3/2003 | Ward Close et al. | |
| 2003/0173228 | A1 | 9/2003 | Strezov et al. | |
| 2004/0011660 | A1 * | 1/2004 | Bradford et al. | 205/385 |
| 2004/0026262 | A1 | 2/2004 | Strezov et al. | |
| 2004/0060826 | A1 | 4/2004 | Godfrey | |
| 2004/0159559 | A1 | 8/2004 | Fray et al. | |
| 2004/0194574 | A1 * | 10/2004 | Cardarelli | 75/10.26 |
| 2004/0237711 | A1 | 12/2004 | Ono et al. | |
| 2005/0050989 | A1 | 3/2005 | Osborn et al. | |
| 2006/0180462 | A1 | 8/2006 | Strezov et al. | |
| 2006/0191799 | A1 | 8/2006 | Strezov | |
| 2007/0131560 | A1 | 6/2007 | Ratchev et al. | |
| 2007/0181438 | A1 | 8/2007 | Olivares et al. | |
| 2007/0193877 | A1 | 8/2007 | Rigby et al. | |
| 2007/0251833 | A1 | 11/2007 | Ratchev et al. | |
| 2008/0047845 | A1 | 2/2008 | Rigby et al. | |
| 2008/0149495 | A1 | 6/2008 | Mukunthan et al. | |

FOREIGN PATENT DOCUMENTS

| | | |
|---|---|---|
| GB | 2359564 | 8/2001 |
| GB | 2362164 | 11/2001 |
| JP | 2004052037 | 2/2004 |
| WO | WO 99/064638 | 12/1999 |
| WO | WO03/002785 | 1/2003 |
| WO | WO 03/038156 | 5/2003 |
| WO | WO 2004/053201 | 6/2004 |
| WO | WO 2004/113593 | 12/2004 |
| WO | WO 2005/031041 | 4/2005 |

OTHER PUBLICATIONS

Skula, L.B. et al., "Bioleaching of Sukinda Laterite Using Ultrasonics", *Hydrometallurgy*, vol. 37, No. 3, pp. 387-391, 1995.

Written Opinion of the International Searching Authority for PCT/AU2004/000809 dated Jul. 20, 2004.

International Preliminary Report on Patentability, Jun. 2005.

* cited by examiner

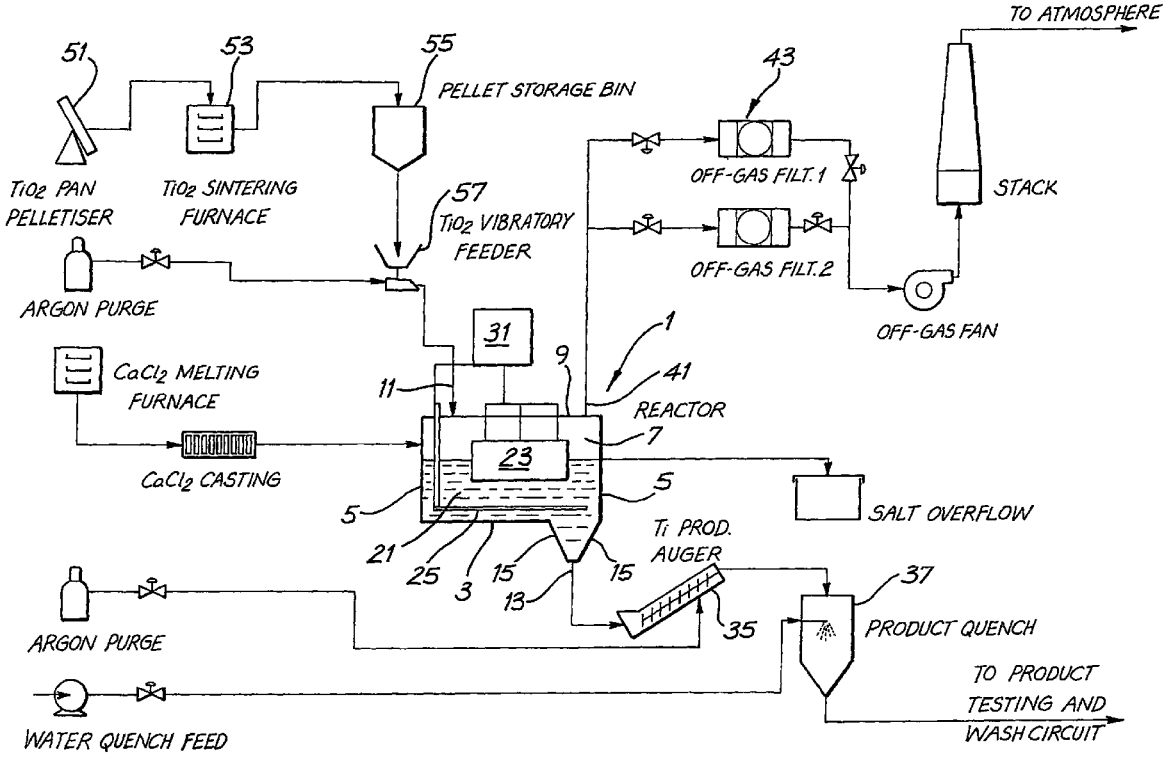
TO ATMOSPHERE
51
53
55
PELLET STORAGE BIN
43
TiO2 PAN PELLETISER
TiO2 SINTERING FURNACE
57
TiO2 VIBRATORY FEEDER
OFF-GAS FILT. 1
STACK
OFF-GAS FILT. 2
ARGON PURGE
OFF-GAS FAN
31
1
9
41
CaCl2 MELTING FURNACE
11
REACTOR
7
23
CaCl2 CASTING
5
5
SALT OVERFLOW
Ti PROD. AUGER
21
25
3
15
15
13
37
35
ARGON PURGE
PRODUCT QUENCH
TO PRODUCT TESTING AND WASH CIRCUIT
WATER QUENCH FEED

ELECTROCHEMICAL REDUCTION OF METAL OXIDES

This application claims priority to PCT Application Ser. No. PCT/AU/2004/000809 filed Jun. 21, 2004 published in English on Dec. 29, 2004 as PCT WO 2004/113593 and to Australian Patent Application No. 2003903150 filed Jun. 20, 2003, the entire contents of both are incorporated herein by reference.

The present invention relates to electrochemical reduction of metal oxides.

The present invention relates particularly to continuous and semi-continuous electrochemical reduction of metal oxides in the form of pellets to produce metal having a low oxygen concentration, typically no more than 0.2% by weight.

The present invention was made during the course of an on-going research project on electrochemical reduction of metal oxides being carried out by the applicant. The research project has focussed on the reduction of titania ($TiO_2$).

During the course of the research project the applicant carried out experimental work on the reduction of titania using electrolytic cells that included a pool of molten $CaCl_2$-based electrolyte, an anode formed from graphite, and a range of cathodes.

The $CaCl_2$-based electrolyte was a commercially available source of $CaCl_2$, namely calcium chloride dihydrate, that decomposed on heating and produced a very small amount of CaO.

The applicant operated the electrolytic cells at a potential above the decomposition potential of CaO and below the decomposition potential of $CaCl_2$.

The applicant found that at these potentials the cell could electrochemically reduce titania to titanium with low concentrations of oxygen, ie concentrations less than 0.2 wt. %.

The applicant does not have a complete understanding of the electrolytic cell mechanism at this stage.

Nevertheless, whilst not wishing to be bound by the comments in this paragraph and the following paragraphs, the applicant offers the following comments by way of an outline of a possible cell mechanism.

The experimental work carried out by the applicant produced evidence of Ca metal dissolved in the electrolyte. The applicant believes that the Ca metal was the result of electrodeposition of $Ca^{++}$ cations as Ca metal on the cathode.

As is indicated above, the experimental work was carried out using a $CaCl_2$-based electrolyte at a cell potential below the decomposition potential of $CaCl_2$. The applicant believes that the initial deposition of Ca metal on the cathode was due to the presence of $Ca^{++}$ cations and $O^{--}$ anions derived from CaO in the electrolyte. The decomposition potential of CaO is less than the decomposition potential of $CaCl_2$. In this cell mechanism the cell operation is dependent on decomposition of CaO, with $Ca^{++}$ cations migrating to the cathode and depositing as Ca metal and $O^{--}$ anions migrating to the anode and forming CO and/or $CO_2$ (in a situation in which the anode is a graphite anode) and releasing electrons that facilitate electrolytic deposition of Ca metal on the cathode.

The applicant believes that the Ca metal that deposits on the cathode directly or indirectly (via dissolution of Ca metal in the electrolyte) participates in chemical reduction of titania resulting in the release of $O^{--}$anions from the titania.

The applicant also believes that the $O^{--}$anions, once extracted from the titania, migrate to the anode and react with anode carbon and produce CO and/or $CO_2$ (and in some instances CaO) and release electrons that facilitate electrolytic deposition of Ca metal on the cathode.

The applicant operated the electrolytic cells on a batch basis with titania in the form of pellets and larger solid blocks in the early part of the work and titania powder in the later part of the work. The applicant also operated the electrolytic cells on a batch basis with other metal oxides.

Whilst the research work established that it is possible to electrochemically reduce titania (and other metal oxides) to metals having low concentrations of oxygen in such electrolytic cells, the applicant has realised that there are significant practical difficulties operating such electrolytic cells commercially on a batch basis.

In the course of considering the results of the research work and possible commercialisation of the technology, the applicant realised that commercial production could be achieved by operating an electrolytic cell on a continuous or semi-continuous basis with metal oxide powders and pellets being transported through the cell in a controlled manner and being discharged in a reduced form from the cell.

International application PCT/AU03/001657 lodged on 12 Dec. 2003 in the name of the applicant describes this invention in broad terms as a process for electrochemically reducing a metal oxide, such as titania, in a solid state in an electrolytic cell that includes a bath of molten electrolyte, a cathode, and an anode, which process includes the steps of: (a) applying a cell potential across the anode and the cathode that is capable of electrochemically reducing metal oxide supplied to the molten electrolyte bath, (b) continuously or semi-continuously feeding the metal oxide in powder and/or pellet form into the molten electrolyte bath, (c) transporting the powders and/or pellets along a path within the molten electrolyte bath and reducing the metal oxide to metal as the metal oxide powders and/or pellets move along the path, and (d) continuously or semi-continuously removing reduced metal oxide from the molten electrolyte bath.

The International application defines the term "powder and/or pellet form" as meaning particles having a particle size of 3.5 mm or less. The upper end of this particle size range covers particles that are usually described as pellets. The terms "powder" and "pellets" as used herein are not intended to limit the scope of patent protection to a particular procedure for producing the particles.

The term "semi-continuously" is understood in the International application and herein to mean that the process includes: (a) periods during which metal oxide powders and pellets are supplied to the cell and periods during which there is no such supply of metal oxide powders and pellets to the cell, and (b) periods during which metal is removed from the cell and periods during which there is no such removal of metal from the cell.

The overall intention of the use of the terms "continuously" and "semi-continuously" in the International application and herein is to describe cell operation other than on a batch basis.

In this context, the term "batch" is understood in the International application and herein to include situations in which metal oxide is continuously supplied to a cell and reduced metal builds up in the cell until the end of a cell cycle, such as disclosed in International application WO 01/62996 in the name of The Secretary of State for Defense.

The disclosure in the International application is incorporated herein by cross reference.

The applicant has carried out further research into commercial production by operating an electrolytic cell on a continuous or semi-continuous basis and has realised that the cell should include a cell cathode in the form of a member, such as a plate, having an upper surface for supporting metal oxide particles in powder and/or pellet form that is horizontally disposed or slightly inclined (upwardly or downwardly)

and has a forward end and a rearward end and is immersed in the electrolyte bath and is supported for movement, preferably in forward and rearward directions, so as to cause metal oxide powders and/or pellets to move toward the forward end of the cathode.

With this arrangement, in use, metal oxide powders and/or pellets are supplied onto the upper surface of the cathode, preferably near the rearward end thereof, and are moved forward by the movement of the cathode and fall off the upper surface at the forward end of the cathode and ultimately are removed from the cell. The metal oxides are reduced as the metal oxides powders and/or pellets move over the upper surface.

The term "powders and/or pellets" is understood herein to mean particles that are less than 5 mm in major dimension.

Accordingly, the present invention provides a process for electrochemically reducing metal oxide powders and/or pellets, such as titania powders and/or pellets, in an electrolytic cell that includes a bath of molten electrolyte, a cathode, and an anode, the cathode being in the form of a member, such as a plate, having an upper surface for supporting metal oxide powders and/or pellets that is horizontally disposed or slightly inclined and has a forward end and a rearward end and is immersed in the electrolyte bath and is supported for, movement so as to cause metal oxide powders and/or pellets on the upper surface of the cathode to move toward the forward end of the member, which process includes the steps of: (a) applying a cell potential across the anode and the cathode that is capable of electrochemically reducing metal oxide supplied to the molten electrolyte bath, (b) continuously or semi-continuously feeding metal oxide powders and/or pellets into the molten electrolyte bath so that the powders and/or pellets deposit on an upper surface of the cathode, (c) causing metal oxide powders and/or pellets to move over the upper surface of the cathode toward the forward end of the cathode while in contact with molten electrolyte whereby electrochemical reduction of the metal oxide to metal occurs as the powders and/or pellets move toward the forward end, and (d) continuously or semi-continuously removing at least partially electrochemically reduced metal oxide powders and/or pellets from the molten electrolyte bath.

Preferably step (b) includes feeding the metal oxide powders and/or pellets into the molten electrolyte bath so that the powders and/or pellets form a layer that is one or two particles deep on the upper surface of the cathode.

The metal oxide powders and/or pellets may be deposited on the upper surface of the cathode in a pile of pellets and may be shaken out into one or two particle deep layer as the cathode moves the powders and/or pellets towards the forward end of the cathode.

Preferably step (c) includes causing metal oxide pellets to move on the upper surface of the cathode toward the forward end of the cathode as a layer of powders and/or pellets that is one or two particles deep.

The layer may be produced by forming the cathode appropriately. For example, the cathode may be formed with an upstanding lip at the forward end that causes powders and/or pellets to build-up behind the lip. Alternatively, or in addition, the cathode may be formed with a series of transversely extending grooves that promote close packing of the powders and/or pellets.

Preferably step (c) includes selectively moving the cathode so as to cause metal oxide powders and/or pellets on the upper surface of the cathode to move toward the forward end of the cathode.

There is a wide range of options for moving the cathode to cause forward movement of powders and/or pellets on the upper surface of the cathode. The applicant has found that it is preferable to move the cathode in forward and rearward directions. The applicant has found that one option that can achieve controlled forward movement of powders and/or pellets includes moving the cathode in a repeated sequence that comprises a short period of oscillating motion in the forward and rearward directions and a short rest period. The applicant has found that this sequence can cause powders and/or pellets on the upper surface of the cathode to move over the upper surface in a controlled series of short steps from the rearward end to the forward end of the cell. The applicant has also found that controlled forward movement of powders and/or pellets may include components of rearward and forward movement of the controlled forward movement of powders and/or pellets, with a net forward movement.

Moreover, the present invention is not confined to operating a cell under constant operating conditions and extends to situations in which the operating parameters, such as the cathode movement, are varied during the operating campaign of the cell.

Preferably step (c) includes moving the cathode so as to cause powders and/or pellets across the width of the cathode to move at the same rate so that the powders and/or pellets have substantially the same residence time within the bath.

Preferably the process electrochemically reduces the metal oxide to metal having a concentration of oxygen that is no more than 0.5% by weight.

More preferably the concentration of oxygen is no more than 0.2% by weight.

The process may be a single or multiple stage process involving one or more than one electrolytic cell.

In the case of a multiple stage process involving more than one electrolytic cell, the process may include successively passing reduced and partially reduced metal oxides from a first electrolytic cell through one or more than one downstream electrolytic cell and continuing reduction of the metal oxides in these cells.

In a situation in which the cathode is in the form of a plate, another option for a multiple stage process includes successively passing reduced and partially reduced metal oxide particles from one cathode plate to another cathode plate or a succession of cathode plates within one electrolytic cell.

Another option for a multiple stage process includes recirculating reduced and partially reduced metal oxide particles through the same electrolytic cell.

Preferably the process includes washing powders and/or pellets that are removed from the cell to separate electrolyte that is carried from the cell with the powders and/or pellets.

The process inevitably results in a loss of electrolyte from the cell and, therefore make-up electrolyte will be required for the cell.

The make-up electrolyte may be obtained by recovering electrolyte that is washed from the powders and/or pellets and recycling the electrolyte to the cell.

Alternatively, or in addition, the process may include supplying fresh make-up electrolyte to the cell.

Preferably the process includes maintaining the cell temperature below the vaporisation and/or decomposition temperatures of the electrolyte.

Preferably the process includes applying a cell potential above a decomposition potential of at least one constituent of the electrolyte so that there are cations of a metal other than that of the cathode metal oxide in the electrolyte.

In a situation in which the metal oxide is titania it is preferred that the electrolyte be a $CaCl_2$-based electrolyte that includes CaO as one of the constituents.

In such a situation it is preferred that the process includes maintaining the cell potential above the decomposition potential for CaO.

Preferably the particle size of the powders and/or pellets is in the range of 0.5-4 mm.

More preferably the particle size of the pellets is in the range of 1-2 mm.

According to the present invention there is also provided an electrolytic cell for electrochemically reducing metal oxide powders and/or pellets, which electrolytic cell includes (a) a bath of a molten electrolyte, (b) a cathode in the form of a member, such as a plate, having an upper surface for supporting metal oxide powders and/or pellets that is horizontally disposed or slightly inclined and has a forward end and a rearward end and is immersed in the electrolyte bath and is supported for movement so as to cause metal oxide powders and/or pellets on the upper surface of the cathode to move toward the forward end of the cathode, (c) an anode, (d) a means for applying a potential across the anode and the cathode, (e) a means for supplying metal oxide powders and/or pellets to the electrolyte bath so that the metal oxide powders and/or pellets can deposit onto an upper surface of the cathode, (f) a means for causing metal oxide powders and/or pellets to move over the upper surface of the cathode toward the forward end of the cathode while in contact with molten electrolyte whereby electrochemical reduction of the metal oxide to metal can occur as the powders and/or pellets move toward the forward end, and (g) a means for removing at least partially electrochemically reduced metal oxides from the electrolyte bath.

Preferably the cathode is a plate.

Preferably the means for causing metal oxide powders and/or pellets to move over the upper surface of the cathode includes a means for moving the cathode so as to cause movement of metal oxide powders and/or pellets.

Preferably the means for causing metal oxide powders and/or pellets to move over the upper surface of the cathode includes a means for moving the cathode in forward and rearward directions.

Preferably the cathode is formed to cause metal oxide powders and/or pellets to move on the upper surface of the cathode toward the forward end of the cathode as a layer that is one or two particles deep.

For example, the cathode may be formed with an upstanding lip at the forward end that causes pellets to build-up behind the lip. Alternatively, or in addition, the upper surface of the cathode may be formed with a series of transversely extending grooves that promote close packing of the pellets.

Preferably the means for applying an electrical potential across the anode and the cathode includes an electrical circuit in which a power source is connected to a forward end of the cathode. The applicant has found that this arrangement results in substantial reduction of titania powders and/or pellets within a short distance from the forward end of the cell.

Preferably the anode extends downwardly into the electrolyte bath and is positioned a predetermined distance above the upper surface of the cathode.

In a situation in which the anode is a consumable anode, for example formed from graphite, preferably the cell includes a means for moving the anode downwardly into the electrolyte bath as the anode is consumed to maintain the predetermined distance between the anode and the cathode.

More preferably the anode is in the form of one or more graphite blocks extending into the cell.

Preferably the cell includes a means for treating gases released from the cell.

The gas treatment means may include a means for removing any one or more of carbon monoxide, carbon dioxide, chlorine-containing gases such as phosgene from the gases.

The gas treatment means may also include a means for combusting carbon monoxide gas in the gases.

In a situation in which the metal oxide is titania it is preferred that the electrolyte be a $CaCl_2$-based electrolyte that includes CaO as one of the constituents.

Preferably the particle size of the powders and/or pellets is in the range of 0.5-4 mm.

More preferably the particle size of the powders and/or pellets is in the range of 1-2 mm.

The present invention is described further by way of example with reference to the accompanying drawing which is a schematic diagram that illustrates one embodiment of an electrochemical process and an electrolytic cell in accordance with the present invention.

The following description is in the context of electrochemically reducing titania pellets to titanium metal having an oxygen concentration of less than 0.3 wt. %. However, it is noted that the present invention is not confined to this metal oxide and extends to other metal oxides.

The electrolytic cell 1 shown in the drawing is an enclosed chamber that is rectangular in top plan and has a base wall 3, a pair of opposed end walls 5, a pair of opposed side walls 7, and a top cover 9.

The cell includes an inlet 11 for titania pellets in the top cover 9 near the left hand end of the cell as viewed in the drawing. This end of the cell is hereinafter referred to as "the rearward end" of the cell. The pellets are formed in a "green" state in a pin mixer 51 and are then sintered in a sintering furnace 53 and thereafter are stored in a storage bin 55. Pellets from the storage bin 55 are supplied via a vibratory feeder 57 to the cell inlet 11.

The cell further includes an outlet 13 for titanium metal pellets in the base wall 3 near the right hand end of the cell as viewed in the drawing. This end of the cell is hereinafter referred to as "the forward end" of the cell. The outlet 13 is in the form of a sump defined by downwardly converging sides 15 and an upwardly inclined auger 35 arranged to receive titanium pellets from a lower end of the sump and to transport the pellets away from the cell.

The cell contains a bath 21 of molten electrolyte. The preferred electrolyte is $CaCl_2$ with at least some CaO.

The cell further includes an anode 23 in the form of a graphite block extending into the bath 21 and supported so that the block can be progressively lowered into the bath 21 as lower sections of the anode graphite are consumed by cell reactions at the anode.

The cell further includes a cathode 25 in the form of a plate that is immersed in the bath 21 and is positioned a short distance above the base wall 3. The cathode plate 25 is supported in the cell so that the upper surface of the cathode plate 25 is horizontal or slightly inclined downwardly from the rearward end to the forward end of the cell. The length dimension of the cathode plate 25 is selected having regard to the residence time required for pellets in the bath. The width dimension of the cathode plate 25 is selected having regard to the total production required. The cathode plate 25 is supported to move in the forward and rearward directions in an oscillating motion.

The applicant has found that movement of the cathode plate 25 in a repeated sequence that comprises a short period of oscillating motion and a short rest period can cause pellets on the upper surface of the cathode plate 25 to move over the upper surface in a series of short steps from the rearward end to the forward end of the cell.

Moreover, the applicant has found that the above-described type of motion can cause pellets across the width of the cathode plate 25 to move at a constant rate so that the pellets have substantially the same residence time within the bath 21.

More particularly, the cell is arranged so that titania pellets supplied to the cell via the inlet 11 fall downwardly onto the upper surface of the cathode plate 25 near the rearward end of the cell and are caused to move forwardly over the upper surface of the cathode plate 25 and fall off the forward end of the cathode plate 25 into the outlet 13. More particularly, the cell is arranged so that, in use, the pellets move forwardly over the upper surface of the cathode plate 25 as a closely packed mono-layer. In order to achieve close packing of the pellets, the cathode plate 25 includes an upstanding lip (not shown) at the forward end thereof that causes pellets to build-up behind the lip along the length of the cathode plate 25.

The applicant has found that it is preferable that the titania pellets be substantially round since it is possible to cause these pellets to move over the upper surface of the cathode plate 25 in a more predictable manner than is possible with more angular pellets.

In addition, the applicant has found that it is undesirable that the pellets "stick" to the upper surface of the plate to an extent that inhibits forward movement of the pellets and that the pellets "stick" together. These considerations support the preference for round pellets. It is relevant to note that oscillating movement of the cathode plate 25 minimises sticking of pellets. In addition, the plate may be coated with materials such as tantalum and titanium diboride to minimise sticking.

The applicant has also found that the size and weight of the pellets should be selected so that the pellets settle quite quickly onto the upper surface of the cathode plate 25 and do not become suspended in the electrolyte in the molten bath 21.

In overall terms, it is preferable to select the smallest possible pellet size that can move over the cathode plate 25 in an efficient manner, i.e. without sticking to the plate, in order to optimise mass throughput of the cell.

The cell further includes a power source 31 for applying a potential across the anode block 23 and the cathode plate 25 and an electrical circuit that electrically interconnects the power source 31, the anode block 23, and the cathode plate 25. The electrical circuit is arranged so that the power source 31 is connected to the rearward end of the cathode plate 25.

In use of the cell, titania pellets are supplied to the upper surface of the cathode plate 25 at the rearward end of the cell so as to form a mono-layer of pellets on the cathode plate 25 and the plate is moved as described above and causes the pellets to step forward over the surface of the plate to the forward end of the cell and ultimately fall from the forward end of the plate. The pellets are progressively electrochemically reduced in the cell as the pellets are moved over the surface of the cathode plate 25. The operating parameters of the cathode plate 25 are selected so that the pellets have sufficient residence time in the cell to achieve a required level of reduction of the titania pellets. Typically, 2-4 mm titania pellets require 4 hours residence time to be reduced to titanium with a concentration of 0.3 wt % oxygen at a cell operating voltage of 3 V.

The applicant has found that the above-described arrangement results in substantial reduction of titania pellets within a short distance from the forward end of the cell.

The applicant has found that there are a number of factors that have an impact on the overall operation of the cell. Some of these factors, namely pellet size and shape and motion of the cathode plate 25, are discussed above. Another relevant factor is the exposed surface areas of the upper surface of the cathode plate 25 and the anode block 23. On the basis of work to date, the applicant believes that larger rather than smaller cathode plates 25 in relation to the exposed surface area of the anode block 23 is preferable. In other words, the applicant believes that a larger rather than a smaller anodic current density is preferable.

In use of the cell, the anode block 23 is progressively consumed by a reaction between carbon in the anode block 23 and $O^{--}$ anions generated at the cathode plate 25, and the reaction occurs predominantly at the lower edges of the anode block 23.

It is preferred that the distance between the upper surface of the cathode plate 25 and the lower edges of the anode block 23 be maintained substantially constant in order to minimise changes that may be required to other operating parameters of the process. Consequently, the cell further includes a means (not shown) for progressively lowering the anode block into the electrolyte bath 21 to maintain the distance between the upper surface of the cathode plate 25 and the lower edges of the anode block 23 substantially constant.

Preferably the distance between the upper surface of the cathode plate 25 and the lower edges of the anode block 23 is selected so that there is sufficient resistance heating generated to maintain the bath 21 at a required operating temperature.

Preferably the cell is operated at a potential that is above the decomposition potential of CaO. Depending on the circumstances, the potential may be as high as 4-5V. In accordance with the above-described mechanism, operating above the decomposition potential of CaO facilitates deposition of Ca metal on the cathode plate 25 due to the presence of $Ca^{++}$ cations and migration of $O^{--}$ anions to the anode block 23 as a consequence of the applied field and reaction of the $O^{--}$ anions with carbon of the anode block 23 to generate carbon monoxide and carbon dioxide and release electrons. In addition, in accordance with the above-described mechanism, the deposition of Ca metal results in chemical reduction of titania via the mechanism described above and generates $O^{--}$ anions that migrate to the anode block 23 as a consequence of the applied field and further release of electrons. Operating the cell below the decomposition potential of $CaCl_2$ minimises evolution of chlorine gas, and is an advantage on this basis.

As is indicated above, the operation of the cell generates carbon monoxide and carbon dioxide and potentially chlorine-containing gases at the anode and it is important to remove these gases from the cell. The cell further includes an off-gas outlet 41 in the top cover 9 of the cell and a gas treatment unit 43 that treats the off-gases before releasing the treated gases to atmosphere. The gas treatment includes removing carbon dioxide and any chlorine gases and may also include combusting carbon monoxide to generate heat for the process.

Titanium pellets, together with electrolyte that is retained in the pores of the titanium pellets, are removed from the cell continuously or semi-continuously at the outlet 13. The discharged material is transported via the auger 35 to a water spray chamber 37 and quenched to a temperature that is below the solidification temperature of the electrolyte, whereby the electrolyte blocks direct exposure of the metal and thereby restricts oxidation of the metal. The discharged material is then washed to separate the retained electrolyte from the metal powder. The metal powder is thereafter processed as required to produce end products.

The above-described cell and process are an efficient and an effective means of continuously and semi-continuously electrochemically reducing metal oxides in the form of pellets to produce metal having a low oxygen concentration Specifically, the electrolytic cell shown in the drawing is one example only of a large number of possible cell configurations that are within the scope of the present invention.

The invention claimed is:

1. A process for electrochemically reducing metal oxide powders and/or pellets in an electrolytic cell that includes a bath of molten electrolyte, a cathode, and an anode, the cathode being in the form of a member having an upper surface for supporting metal oxide powders and/or pellets that is horizontally disposed or slightly inclined and has a forward end and a rearward end and is immersed in the electrolyte bath and is supported for movement so as to cause metal oxide powders and/or pellets on the upper surface of the cathode to move toward the forward end of the member, which process includes the steps of:

a. applying a cell potential across the anode and the cathode that is capable of electrochemically reducing metal oxide supplied to the molten electrolyte bath, b. continuously or semi-continuously feeding metal oxide powders and/or pellets into the molten electrolyte bath so that the powders and/or pellets deposit on an upper surface of the cathode, c. causing metal oxide powders and/or pellets to move over the upper surface of the cathode toward the forward end of the cathode while in contact with molten electrolyte whereby electrochemical reduction of the metal oxide to metal occurs as the powders and/or pellets move toward the forward end, and d. continuously or semi-continuously removing at least partially electrochemically reduced metal oxide powders and/or pellets from the molten electrolyte bath.

2. The process defined in claim 1 wherein step (b) includes feeding the metal oxide powders and/or pellets into the molten electrolyte bath so that the powders and/or pellets form a layer that is one or two particles deep on the upper surface of the cathode.

3. The process defined in claim 1 wherein step (b) includes feeding the metal oxide powders and/or pellets into the molten electrolyte bath so that the powders and/or pellets deposit as a pile of powders and/or pellets on the upper surface of the cathode and step(c) causes the powders and/or pellets in the pile to be shaken out into a layer that that is one or two particles deep and moves over the upper surface of the cathode toward the forward end of the cathode.

4. The process defined in claim 1 wherein step (c) includes causing metal oxide powders and/or pellets to move on the upper surface of the cathode toward the forward end of the cathode as a layer of powders and/or pellets that is one or two particles deep.

5. The process defined in claim 1 wherein step (c) includes selectively moving the cathode so as to cause metal oxide powders and/or pellets on the upper surface of the cathode to move toward the forward end of the cathode.

6. The process defined in claim 5 wherein step (c) includes moving the cathode in forward and rearward directions so as to cause metal oxide powders and/or pellets on the upper surface of the cathode to move toward the forward end of the cathode.

7. The process defined in claim 6 includes moving the cathode in a repeated sequence that comprises a short period of oscillating motion in the forward and rearward directions and a short rest period.

8. The process defined in claim 1 wherein step (c) includes moving the cathode so as to cause powders and/or pellets across the width of the cathode to move at the same rate so that the powders and/or pellets have substantially the same residence time within the bath.

9. The process defined in claim 1 includes washing powders and/or pellets that are removed from the cell and separating electrolyte that is carried from the cell with the pellets.

10. The process defined in claim 9 includes recovering electrolyte that is washed from the powders and/or pellets and recycling the electrolyte to the cell.

11. The process defined in claim 1 includes applying a cell potential above a decomposition potential of at least one constituent of the electrolyte so that there are cations of a metal other than that of the cathode metal oxide in the electrolyte.

12. The process defined in claim 11 wherein, in a situation in which the metal oxide is titania the electrolyte be a $CaCl_2$-based electrolyte that includes CaO as one of the constituents, the process includes maintaining the cell potential above the decomposition potential for CaO.

13. The process defined in claim 1 wherein the particle size of the at least partially electrochemically reduced powders and/or pellets is in the range of 0.5-4 mm.

14. An electrolytic cell for electrochemically reducing metal oxide powders and/or pellets, which electrolytic cell includes a. a bath of a molten electrolyte, b. a cathode in the form of a member having an upper surface for supporting metal oxide powders and/or pellets that is horizontally disposed or slightly inclined and has a forward end and a rearward end and is immersed in the electrolyte bath and is supported for movement so as to cause metal oxide powders and/or pellets on the upper surface of the cathode to move toward the forward end of the cathode, c. an anode, d. a means for applying a potential across the anode and the cathode, e. a means for supplying metal oxide powders and/or pellets to the electrolyte bath so that the metal oxide powders and/or pellets can deposit onto an upper surface of the cathode, f. a means for causing metal oxide powders and/or pellets to move over the upper surface of the cathode toward the forward end of the cathode while in contact with molten electrolyte whereby electrochemical reduction of the metal oxide to metal can occur as the powders and/or pellets move toward the forward end, and g. a means for removing at least partially electrochemically reduced metal oxides from the electrolyte bath.

15. The cell defined in claim 14 wherein the cathode is a plate.

16. The cell defined in claim 14 wherein the means for causing metal oxide powders and/or pellets to move over the upper surface of the cathode includes a means for moving the cathode so as to cause movement of metal oxide powders and/or pellets.

17. The cell defined in claim 16 wherein the means for causing metal oxide powders and/or pellets to move over the upper surface of the cathode includes a means for moving the cathode in forward and rearward directions.

18. The cell defined in claim 14 wherein the cathode is formed to cause metal oxide powders and/or pellets to move on the upper surface of the cathode toward the forward end of the cathode as a layer of powders and/or pellets that is one or two particles deep.

19. The cell defined in claim 18 wherein the cathode is formed with an upstanding lip at the forward end that causes powders and/or pellets to build-up behind the lip.

20. The cell defined in claim 18 wherein the upper surface of the cathode is formed with a series of transversely extending grooves that promote close packing of the powders and/or pellets.

21. The cell defined in any one of claim 14 wherein the means for applying a potential across the anode and the cathode includes an electrical circuit in which a power source is connected to a forward end of the cathode.

22. The cell defined in claim 14 wherein the anode extends downwardly into the electrolyte bath and is positioned a predetermined distance above the upper surface of the cathode.

23. The cell defined in claim 22 includes a means for moving the anode downwardly into the electrolyte bath as the anode is consumed to maintain the predetermined distance between the anode and the cathode.

* * * * *